US007332202B2

(12) United States Patent
Demars et al.

(10) Patent No.: US 7,332,202 B2
(45) Date of Patent: Feb. 19, 2008

(54) INSULATING GLAZING AND THE PRODUCTION METHOD THEREOF

(75) Inventors: Yves Demars, Clermont (FR); Jean-Pierre Douche, Le Plessis Brion (FR); Jean-Christophe Elluin, Choisy au Bac (FR)

(73) Assignee: Saint-Gobain Glass France, Courbevoie (FR)

( * ) Notice: Subject to any disclaimer, the term of this patent is extended or adjusted under 35 U.S.C. 154(b) by 311 days.

(21) Appl. No.: 10/491,435

(22) PCT Filed: Oct. 16, 2002

(86) PCT No.: PCT/FR02/03533

§ 371 (c)(1),
(2), (4) Date: Apr. 12, 2004

(87) PCT Pub. No.: WO03/040507

PCT Pub. Date: May 15, 2003

(65) Prior Publication Data

US 2005/0003116 A1 Jan. 6, 2005

(30) Foreign Application Priority Data

Oct. 17, 2001 (FR) ..... 01 13354

(51) Int. Cl.
*E06B 3/66* (2006.01)
*E04C 2/54* (2006.01)

(52) U.S. Cl. ..... 428/34; 156/109; 52/786.1

(58) Field of Classification Search ..... 428/34, 428/192; 52/786.1, 786.13; 156/107, 109
See application file for complete search history.

(56) References Cited

U.S. PATENT DOCUMENTS

| | | | | | |
|---|---|---|---|---|---|
| 2,173,649 | A | * | 9/1939 | Firner | 52/786.1 |
| 2,213,468 | A | * | 9/1940 | Haven | 428/34 |
| 2,235,680 | A | * | 3/1941 | Haven et al. | 428/34 |
| 2,618,819 | A | * | 11/1952 | Goodwillie | 428/34 |
| 2,741,809 | A | * | 4/1956 | Englehart et al. | 428/34 |
| 3,758,996 | A | * | 9/1973 | Bowser | 55/385.1 |
| 3,772,843 | A | * | 11/1973 | Leder | 52/786.1 |
| 3,832,254 | A | | 8/1974 | Mazzoni et al. | |
| 3,921,359 | A | * | 11/1975 | Brichard et al. | 52/786.13 |
| 4,222,213 | A | * | 9/1980 | Kessler | 52/786.13 |
| 4,422,280 | A | * | 12/1983 | Mertin et al. | 52/786.1 |
| 6,055,783 | A | * | 5/2000 | Guhl et al. | 52/204.62 |

* cited by examiner

*Primary Examiner*—Donald J. Loney
(74) *Attorney, Agent, or Firm*—Oblon, Spivak, McClelland, Maier & Neustadt, P.C.

(57) ABSTRACT

An insulating glazing unit including at least two glass sheets spaced apart by a gas-filled cavity, an insert that serves to keep the two glass sheets apart and that has an internal face facing the gas-filled cavity and an opposed external face, and a sealing with respect to the inside of the glazing unit. The insert includes a substantially flat strip that surrounds a first part of the perimeter of the glazing unit, being pressed by its internal face against the edges of the glass sheets and kept fastened by a fastener, and another strip that surrounds a second part of the perimeter of the glazing unit.

27 Claims, 4 Drawing Sheets

INSULATING GLAZING AND THE PRODUCTION METHOD THEREOF

BACKGROUND

1. Field of Invention

The subject of the invention is an insulating glazing unit and its manufacturing process.

2. Description of Related Art

One well-known type of insulating glazing unit comprises two glass sheets which are spaced apart by a cavity filled with gas, such as air, and which are kept apart and joined together by means of a spacer frame consisting of hollow metal strips folded over or assembled by corner pieces. The strips are provided with a molecular sieve whose function is especially to absorb the water molecules that are trapped during manufacture of the glazing unit in the intermediate air cavity and that would be liable to condense in cold weather, which causes the appearance of fogging.

To ensure that the glazing unit is sealed, the spacer frame is adhesively bonded to the glass sheets by an elastomer bead of the butyl rubber type, applied directly to the strips by extrusion through a nozzle. Each corner of the spacer frame is also provided at a corner piece with butyl rubber. Once the glazing has been assembled, the elastomer sealing bead has a function of temporarily providing mechanical retention of the glass sheets. Finally, a crosslinkable sealing mastic, of the polysulfide or polyurethane type, is injected into the peripheral groove bounded by the two glass sheets and the spacer frame, thereby completing the mechanical assembly of the glass sheets. The main function of the butyl rubber is to seal the inside of the glazing unit with respect to water vapor, whereas the mastic seals against liquid water and solvents.

The manufacture of this glazing unit requires several different materials, including the strips, the corner pieces, the molecular sieve and the organic seals, these materials not being assembled in one and the same operation.

SUMMARY

One drawback associated with such a manufacturing process is that of storing the materials. In order to be operational in respect of any new order for insulating glazing units, many batches of each material must be available, which does not contribute to simple and rapid management as regards the positioning and storage of these materials.

Furthermore, the present number of materials to be assembled involves several mounting operations which, although automated, are carried out one after another, which appreciably disadvantages the manufacturing time. Some of these operations also involve interruptions in the manufacturing line, these short periods of lost time possibly further disadvantaging productivity.

In addition, the regeneration of the molecular sieve with which the inside of the hollow strips is provided is impossible with the insulating glazing units known at the present time, as it involves their destruction.

The object of the invention is therefore to obviate these drawbacks by providing an insulating glazing unit whose choice of materials makes it possible to facilitate the management of their manufacturing flow, to simplify the mounting operations and to restore the glazing unit without destroying it, especially by replacing the granular molecular sieve and/or reintroducing gas.

According to the invention, the insulating glazing unit, which comprises at least two glass sheets spaced apart by a gas-filled cavity, an insert that serves to keep the two glass sheets apart and has an internal face facing the gas-filled cavity and an opposed external face, and means for sealing with respect to the inside of said glazing unit, is characterized in that the insert comprises a substantially flat strip which surrounds a first part of the perimeter of the glazing unit, being pressed via its internal face against the edges of the glass sheets and kept fastened by fastening means, and another strip which surrounds a second part of the perimeter of the glazing unit.

This type of strip and its arrangement on the edges of the glazing unit has especially the advantage of increasing the visibility through the glazing unit in those parts of its periphery having as insert only the substantially flat strip.

There may be partial or even complete overlap of said first and second parts of the perimeter of the glazing unit, provided that the conventional spacing and sealing functions of the insert are fulfilled. In many cases, the second part of the perimeter occupied by said other strip does not represent the entire perimeter. This is because, if the other strip is hollow, the major benefit of the invention lies in taking advantage of the extreme ease of bonding and debonding the substantially flat strip, especially so as to be able to gain access to the inside of the hollow strip in order to replace the desiccating molecular sieve that it contains; now, this accessibility is optimal when the hollow strip occupies part, but not all, of the perimeter of the glazing unit, for example the lower horizontal side, or only a fraction of a straight side. The rebonding of the flat strip after it has been debonded poses no problem with many choices of standard materials.

The term "other strip" is understood within the context of the invention to mean a strip that is not essentially flat, hollow or solid, of square, rectangular or more complex cross section, having for example one side of length corresponding substantially to the thickness of the gas-filled cavity.

The glazing unit of the invention comprises at least two glass sheets, mainly three or more, spaced apart, each being either a monolithic glass sheet or a laminate of glass and plastic sheets.

In accordance with two embodiments that are not mutually exclusive:

- said other strip is pressed via its internal face against the edges of the glass sheets, either directly or with interposition, for example, of said substantially flat strip;
- said other strip is at least partly located between the glass sheets.

In both cases, the other strip may be adhesively bonded to the glass sheets, whether to their edges or to their internal surfaces. However, it is also possible that such bonding is not effected, for example, in configuration such as:

- another strip pressed against the edges of the glass sheets and completely enveloped by the flat strip itself, adhesively bonded to the glass; and
- another strip, completely between the glass sheets, on the lower horizontal side, bearing by gravity on the internal face of the flat strip, or with clamping between the two glass sheets.

Advantageously, the other strip comprises at least a part which lies outside the space bounded by the glass sheets and has a shape suitable for fitting and/or fastening the glazing unit in the opening for which it is intended. It is thus conceivable for this outer part of the other strip to form a tongue over the entire length of the strip and for this tongue to be able to fit closely into a groove formed in the frame of the opening, thereby making superfluous the subsequent fastening, by nailing or an equivalent method, of a beading, called a glazing bead, to this perimeter part of the glazing unit.

Preferably, the insert possesses properties whereby it seals against gases and dust and against liquid water.

The sealing means of the substantially flat strip are placed at least on the external face or at least on the internal face of the insert. In the latter case, the external face of the substantially flat strip advantageously has irregularities capable of ensuring the fitting and/or centering and/or fastening of the glazing in the opening for which it is intended. These irregularities may consist of longitudinal striations such as those obtained by extrusion of a thermoplastic or a similar process. In this regard, reference may be made to the application EP-0 745 750 A1 which describes (FIGS. 7 and 8) stepped striations with one side inclined and the other straight, arranged along inclined ramps and designed to fasten the glazing unit in its frame, with simultaneous centering, by simple pressing. Striations of this type fall perfectly within the present embodiment.

The sealing means of the substantially flat strip may consist of a coating made of metal, preferably stainless steel or aluminum, which has a thickness of between 2 and 50 μm.

The substantially flat strip may be made entirely of metal.

When the strip is made of plastic, it is provided with a metal coating in order to constitute the gas and water-vapor sealing means as indicated above.

This coating may be just as well on the outer face as on the inner face of the gas-filled cavity side. There are advantages in arranging it preferably on the inner face, namely a smaller thickness will be necessary, since there will be no need to withstand the external shocks or scratching, the thermal bridge around the periphery of the glazing unit will be thinner, its bonding, especially if it is made of aluminum, to the glass is perfectly controlled whatever the plastic used for the strip, and finally it may make it easier to make electrical connection to the electrical elements provided inside the glazing unit.

According to one feature, the insert has a linear buckling strength of at least 400 N/m. To ensure this strength, the flat strip must have a thickness of at least 0.1 mm when it consists entirely of stainless steel, of at least 0.15 mm when it is entirely made of aluminum and at least 0.25 when it is made of a thermo-plastic reinforced with reinforcing fibers.

Advantageously, the means for fastening the insert to the glazing unit are impermeable to water and they consist of an adhesive which has a tear strength of at least 0.45 MPa.

According to another feature, the free ends of the substantially flat strip are joined together in order to surround all or part of the glazing unit so that one of the ends overlaps the other, or one end of said other strip, supplementary sealing means being provided in order to seal off lateral sections left open by the overlap.

As a variant, to surround the entire glazing unit, the free ends of the substantially flat strip are of complementary shapes suitable for mutually cooperating in order for them to be assembled as an abutment. An adhesive tape or adhesive impermeable to gases and to water vapor will preferably be applied to the abutment region.

The insulating glazing unit may be of complex shape, in particular with curved parts, to which the flat insert is perfectly suited as it is able, through its flexibility, to easily follow the curves of the glazing unit.

According to another feature, either or both of the faces of the insert has/have functional elements structured by forming or materially attached.

Thus, it is possible for the strip to be shaped in very precise shapes. Before it is fitted, the strip may be formed by rolling or any other suitable means for incorporating various elements for functional purposes. As an example, it is possible to structure the faces of the strip with studs, dimples or bumps, placed in discrete points or continuously, arranged for example in two parallel bands, or in a staggered fashion, or by providing sharp edges in the corners, such as punches, serrations or prescoring.

The studs may especially serve as retention elements for fastening the cross members installed in the gas-filled cavity, these cross members having a decorative function.

If these studs are placed toward the inside of the glazing unit and in at least two parallel bands, they may serve as elements for guiding and fitting at least one additional glass sheet for the manufacture of a triple, or even quadruple, glazing unit. However, they may also serve as elements for holding a glass sheet in place which, by thus resting on these elements, allows communication between the various air-filled cavities of the glazing unit. These elements, if their functionality is toward the outside of the glazing unit, may also make it easier to mount by insertion, fit, lock or install the glazing unit in the rebate of the window or with adjacent walls or glazing units, or else these elements may constitute a path for cooperation with a rail, for a sliding door.

Of course, it is conceivable to add further elements to the strip by other means, depending on the nature of material on the strip, by adhesive bonding, soldering, welding or riveting without the integrity of the strip being thereby modified, even though it may be re-established if it is modified. In addition, by grasping on additional parts it will be possible to form inserts that further improve the rigidity and inertia of the strip for assembling the glazing, or else contributing to installing it, especially mounting it in the rebate.

There may also additions of further materials by plastic studs or by the extrusion of profiled lips or grooves for sealing or for decoration.

Apart from these additions, it is quite conceivable beforehand to apply anticorrosion treatment or a paint or a decorative lacquer to the strip, and also to stamp or print any marking or information for the purpose, for example, of providing traceability of the glazing unit manufactured.

The insert, of substantially flat shape, may have recesses or double walls that may constitute or house functionality's, for example breathing tubes (i.e. tubes permitting the pressures between the inside and the outside of the glazing unit to be balanced without convection).

The insert of the invention advantageously includes one or more of the following functionalities:

- it contains a desiccant, especially in a recess incorporated into the shape of the insert or attached to the insert;
- it includes control, mechanical-transmission or electrical-connection means (electrical wires, conducting elements for heating the edges of the glazing unit, printed circuits), the conductors being led out, for example, in the abutment region;
- it incorporates a venetian blind installed in the gas-filled cavity; and
- it incorporates a means of measuring the moisture content in the gas-filled cavity, so as to predict the moment when it is necessary to restore the glazing unit, by removing, washing and refitting it and by regenerating the desiccant.

It is particularly advantageous, thanks to the invention, to associate a said substantially flat strip with three of the four sides of the glazing unit, to install one of the aforementioned functionalities via the free side of the glazing unit and then to adhesively bond a said substantially flat strip to the latter.

In one embodiment, the insert has at least one hole so as to be able, for example, to affix a desiccant cartridge, or a gas cartridge so as to fill the space between the glass sheets with gas, and also to be able to undertake pressure balancing when the glazing unit has been manufactured in a location where atmospheric pressure is different from that of the point of delivery, or else the hole or holes may allow controlled circulation of air between the glass sheets so as to constitute a breathing glazing unit very useful, for example, for an oven door. This hole may be produced in the substantially flat strip, or else in the other strip, or in both, the two holes being advantageously, in the latter case, facing each other. The hole may or may not be in direct communication with the gas-filled cavity (for example when there is an end section of hollow strip, in which sealing is provided by overlap with a substantially flat strip). The hole may or may not be a through hole; thus, it may result only from the local absence of the impermeable layer, made of aluminum or other material, but not from the underlying, possibly gas-permeable, layer.

This hole may be obtained by any suitable piercing means or by an element attached to the strip provided with a punch, by piercing the strip at the indicated point, or for example by a preshaped impression on the strip, or by the precise positioning of the attached element by virtue of locating bumps shaped beforehand on the strip, as explained above. The piercing impression may, for example, be of the type provided in commercial aluminum drinks cans; once piercing has taken place, the portion of material pushed back remains attached to the strip.

It the hole has been produced for the injection of gas, it is then advisable to seal it up again, for example with a gas-impermeable foil, which is mechanically fastened to the strip by various means, such as with the use of a suitable sealing adhesive.

Thus, the tape may be adhesively bonded via one of its faces to that face of the foil intended to be applied against the holed strip. The tape has, on its opposite face, a nonstick protective film which allows, during application of the foil against the strip, to modify the position of said foil so as to place it correctly in the desired location. A tongue is provided laterally to the strip and can be pulled so as to remove the protective film in order to expose the adhesive which will ensure that the foil is bonded to the strip.

The invention also covers a particular glazing unit in which the edges of said two glass sheets are at least partly offset with respect to each other. It is conceivable that only one side of one of the two sheets extends beyond the corresponding side of the other of the two sheets, the offset space being occupied by said other strip, over the entire length of the side. It is also possible for one of said two glass sheets to be a laminate whose sheet oriented toward the outside of the glazing unit is of larger dimensions than the other constituents of the laminate, adhesively bonded to the edge of which constituents on the one hand, and to the edge of the other of said two glass sheets on the other hand, is a said substantially flat strip.

Another particular insulating glazing unit according to the invention is distinguished by the fact that at least one of said two glass sheets has a through-hole and that the edges of this hole are considered as forming part of said first part of the perimeter of the glazing unit, a substantially flat strip being pressed against and adhesively bonded in a sealed manner to these edges. If the through-hole is a disc, the flat strip is shaped in the form of a tube in which are provided, as the case may be, means for fastening the glazing unit to a building structure or the like.

Finally, the fact that the insert is placed on the edges of the glass sheets means that the internal peripheral surface of the glass sheets which are close to the edges is left free, whereas in the prior art this surface is occupied by the insert. It is thus possible to use this free surface for fixing elements, such as decorative cross members, for example by adhesive bonding. When the glazing unit is incorporated into a window frame, the fastening is invisible because it lies within the rebate of the window, away from daylight.

A first manufacturing process of the invention is characterized in that:

- said other strip, provided as the case may be with its means for fastening to the glazing unit, and the two glass sheets, kept parallel and spaced apart, are assembled;
- the internal face of the substantially flat strip provided with the fastening means is placed against the edges of the glass sheets and, as the case may be, on the external face of the other strip;
- during the step of placing the substantially flat strip, pressure means are applied almost instantaneously on the external face of the latter so as to ensure that it adheres to the edges of the glass sheets and, as the case may be, to the other strip; and
- the two ends of the substantially flat strip are securelly joined, either one end to the other, or each of the ends to one end of the other strip.

According to one feature, the substantially flat strip before being put into place is in the form of a wound tape intended to be unwound, stretched and cut to the desired length, whereas the adhesive type fastening means are deposited by injection means onto the tape being stretched.

Advantageously, the desiccant is deposited onto the tape being stretched, during application of the fastening means.

According to another feature, the substantially flat strip is put into place by pressing down on it at a starting point against the edges of a first side of the glazing unit, the surrounding operation taking place from this starting point and the tape being placed over the corners of the glazing unit in the case of a substantially flat strip based on a thermoplastic by preheating its external face so as to help it to be bent around the corners and match their contour perfectly.

Preferably, the starting point is located midway along one side of the glazing unit so as to apply and compress the substantially flat strip simultaneously in the two opposite directions, thereby making it possible to save manufacturing time.

As a variant, the starting point may be located instead at a corner of the glazing unit.

In an alternative method of surrounding the glazing unit, the substantially flat strip is put into place by applying two tapes and pressing down on them at two starting points using delivery and compression means, and the surrounding operation takes place from these starting points by translational movements of the glazing unit and/or of the delivery means. This variant, combined with the strip of the invention, very advantageously makes it possible to provide a glazing unit of complex shape, in particular one with curved parts.

In practice, all the operations of manufacturing the glazing unit may be carried out in a chamber filled with the gas that has to be contained within the glazing unit. However, as a variant, it is possible to envision a gas feed device inserted between the two glass sheets, in order to deliver gas, while the glazing unit is undergoing the surrounding operation, and said device is removed just before the end of the surrounding operation.

A second manufacturing process of the invention is characterized in that:

the two glass sheets are kept parallel and spaced apart;

the internal face of the substantially flat strip, provided with the means for fastening against the edges of the glass sheets, is placed around the entire perimeter of the glazing unit;

while the substantially flat strip is being put in place, pressure means are applied almost instantaneously on its external face so as to ensure that it adheres to the edges of the glass sheets;

after the entire glazing unit has been surrounded, the two ends of the substantially flat strip are securely joined together;

a hole in the substantially flat strip is sealed off by means of a said other strip, the hole possibly being drilled by the coming-together of the substantially flat strip and of the other strip shaped for this purpose with a self-boring means, this operation requiring the use of means for making said other strip adhere to the substantially flat strip, such as an adhesive tape, optionally combined with an injected adhesive.

BRIEF DESCRIPTION OF THE DRAWINGS

Further features and advantages of the invention will become apparent on reading the description which follows and in conjunction with the appended drawings in which.

DETAILED DESCRIPTION OF EXEMPLARY EMBODIMENTS

Figure 1A:
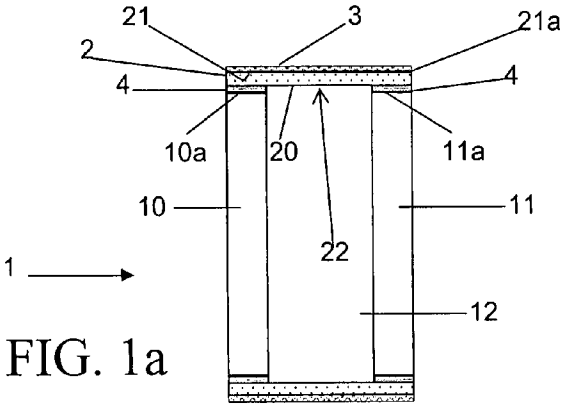
FIG. 1*a* is a sectional view of the insulating glazing unit according to the invention in which the hollow strip does not appear.

FIG. 1*a* illustrates a simple insulating glazing unit 1 obtained by a manufacturing process that will be described below with regard to its device shown in FIG. 2.

The glazing unit 1 comprises two glass sheets 10 and 11 spaced apart by a gas-filled cavity 12, an insert 2 which serves to keep the two glass sheets spaced apart and has the function of ensuring mechanical retention of the entire glazing unit, and sealing means 3 intended to seal the glazing unit against liquid water, solvents and water vapor.

The insert 2 is in the form of a substantially flat strip approximately 1 mm in thickness and substantially parallelepipedal in cross section. Advantageously, this strip has a low mechanical inertia, that is to say that it can be easily wound up with a small winding radius of 10 cm for example.

The strip surrounds the perimeter of the glazing unit. It is placed in the manner of a tape on the edges 10*a* and 11*a* of the glass sheets and guarantees mechanical assembly of the glazing unit by virtue of the fastening means 4 which ensure total adhesion to the glass.

The strip is strong enough to provide the function of mechanically keeping the two glass sheets spaced apart. Its strength is defined by the very nature of its constituent material, the linear buckling strength of which must be at least 400 N/m.

Moreover, the nature of the material of said strip is also chosen so that, during the process of manufacturing the glazing unit, the strip can present sufficient flexibility for the operation of surrounding the glass edges, in particular when bordering the corners, to be carried out.

In a first embodiment, the insert is made entirely of metal, the material chosen being preferably stainless steel or aluminum. During the process, the corners are bordered by bending using machines well known to those skilled in the art in the conversion of metallic material.

In order to guarantee a minimum linear buckling strength of 400 N/m, the insert must have a thickness of at least 0.1 mm in the case of stainless steel and 0.15 mm in the case of aluminum.

In a second and preferred embodiment of the invention, the insert 2 is based on a plastic, which may or may not be reinforced with chopped or continuous reinforcing fibers. Thus, one material may be styrene acrylonitrile (SAN) combined with chopped glass fibers, this product being sold, for example, under the name LURAN® by BASF, or else polypropylene reinforced with continuous glass fibers, this product being sold under the name TWINTEX® by Vetrotex.

It is also possible to produce the insert from a combination of materials such as plastic and metal in order to form, for example, an insert with a thickness of plastic solidly combined with a thickness of metal.

It should be noted, in the case of a plastic which is a thermoplastic, the operation of bordering corners of the glazing unit, by bending the material after it has been softened, is carried out more easily than with an entirely metallic material.

Moreover, with the use of plastic, provision may very advantageously be made for the desiccant to be intrinsically incorporated, partly or completely, into the strip, this being impossible with metal. The desiccant may be a molecular sieve such as powdered zeolite, the proportion of which may be up to 20% by weight or about 10% by volume. The amount of desiccant depends on the lifetime that it is wished to assign on the glazing unit.

Finally, since the plastic is less heat conducting than the metal, the thermal insulation of the entire glazing unit is but better when the glazing unit is exposed, for example, to strong sunlight.

As regards the addition of glass fibers to the plastic, this results in a thermal expansion coefficient of the material which is much lower than that of a pure plastic and which becomes close to the coefficient of the glass. This generates, during a thermal variation of the gas-filled cavity, a lower shear force on the fastening means 4.

To ensure a linear strength of 400 N/m, the insert 2 has a thickness of at least 0.2 mm when it consists of a thermoplastic and reinforcing fibers.

The width of the insert 2 is tailored to the total thickness of the glazing unit, which may be a multiple glazing unit comprising several glass sheets spaced apart by gas-filled cavities. Advantageously, with the insert of the invention it is required to know only the total width of the glazing unit and not the separating distances of the glass sheets. This is because the separating distances for a multiple glazing unit may vary, which necessarily means that, in the case of the use of inserts according to those of the prior art, having to have available, for manufacturing the glazing unit, several inserts for the different separations and different widths of inserts depending on the separating distances.

For the entire glazing unit, it is therefore necessary to simply have, according to the invention, one insert or strip having a single width corresponding to the total width of the glazing unit, whatever the number of internal isolating separations of this spacing unit and the width of the separations.

It has been demonstrated that the glazing unit of the invention with its insert placed on the edges of the glass sheets does not lose out in terms of strength but, on the contrary, the strength is further improved compared with a standard glazing unit of the prior art which has its insert placed between the internal faces of the glass sheets.

The ratio of the deflection of the glazing unit of the invention to that of a standard glazing unit has been calculated as a function of the thickness of the air cavity for glass sheets having the same surface area, the same glass thickness and the same air cavity thickness. For this purpose, a given force is applied to each of the glazing units, the maximum deflection of each glazing unit is then measured and then the ratio of the deflections is calculated. This ratio, being equal to the deflection of the standard glazing unit divided by the deflection of the glazing unit of the invention, is always greater than 1 on account of the better resistance to bending and therefore the better strength of the glazing unit of the invention.

Figure 6:
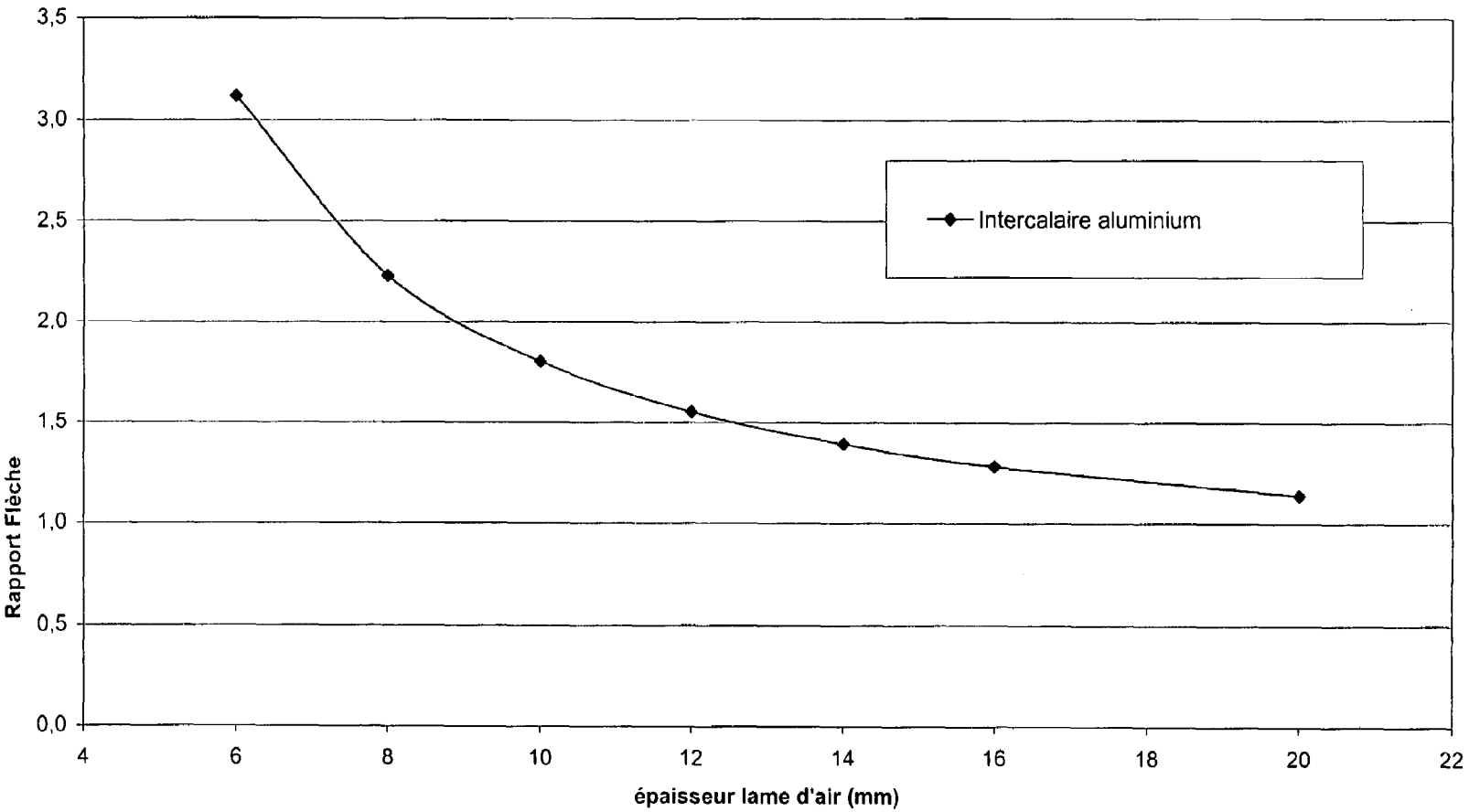
FIG. 6 shows a curve plotting the ratio of the maximum deflection of a standard glazing unit of the prior art to the maximum deflection of a glazing unit of the invention for a given force as a function of the thickness of the air cavity.

FIG. 6 illustrates this ratio as a function of the air cavity, the insert in question for the insulating glazing unit of the invention being a 0.5 mm aluminum strip. It may be seen that the ratio is always greater than 1 and is, for example, 1.5 for a 12 mm air cavity.

According to the invention, the insert or the strip 2 has an internal face 20 and an opposed external face 21, the internal face 20 being intended to be pressed and held in place, via its edges in the case of a single insulating glazing unit, against the edges 10*a* and 11*a* of the glass sheets by virtue of the fastening means 4.

The internal face 20 of the strip possesses, in its central part 22 facing the gas-filled cavity 12, the properties of those of a desiccant whose purpose is to absorb the water molecules that may be trapped within the gas-filled cavity. These desiccating properties may result from the nature of the material of the insert, the very composition of which incorporates a molecular sieve. As a variant, the desiccating element may instead be obtained by depositing a molecular sieve on the central part 22 before the insert is placed on the edges of the glazing unit, as will be seen in the rest of the description.

The edges of the internal face 20 are covered with an adhesive, which constitutes the fastening means 4.

The adhesive is of the cement type; it is impermeable to gases and to water vapor. Tests carried out in accordance with United States Standard ASTM 96-63T on specimens of adhesive 1.5 mm in thickness have shown that an adhesive having a water vapor permeability coefficient of 35 g/24 $h \cdot m^2$, like that of silicon, is suitable. Of course, an adhesive having a permeability coefficient of 4 g/24 $h \cdot m^2$, like polyurethane, or even lower, is more suitable since, sealing being further improved, a smaller amount of desiccant then has to be provided.

The adhesive must also withstand debonding by liquid water, by ultraviolet radiation and by pulling forces that may be exerted perpendicularly to the faces of the glazing unit, usually called shear stresses, and by the pulling forces exerted parallel to the force of the weight of the glazing unit. A satisfactory adhesive must have a tear strength of 0.45 MPa.

It will also be judicious to tailor the nature of the adhesive to the operating environments of the glazing unit; thus, the adhesive will have to have, for example, a temperature withstand capability sufficient for the application of the glazing unit to the door of a domestic electric oven.

Preferably, the adhesive possesses rapid bonding properties, bonding in the order of a few seconds; it is an adhesive whose setting takes place by chemical reaction, whether or not activated by heat or pressure, or else takes place by cooling if the adhesive consists of a hot-melt material, for example one based on a polyurethane that can crosslink in contact with the moisture of the air.

The external face 21 of the reinforced plastic insert is covered with a metallic protective coating 21*a* of the aluminum or stainless steel foil type with a thickness of, for example, between 2 and 50 μm, this coating constituting the sealing means 3. Apart from its sealing role, the foil, particularly when it is made of stainless steel, provides the strip with effective protection against abrasion, for example when handling it or transporting it. Finally, the strip favors heat exchange with the thermoplastic when the manufacturing process involves softening the latter.

As a variant, the metal coating 21*a* could be wide enough to cover the external face 21 and be folded down along the edges of the internal face 20.

The numbers given above regarding the thickness of the insert, depending on the nature of the material or materials used, are given for a linear buckling strength of 400 N/m, which is a conventional value for glazing units of the most standard size, namely 1.20 m by 0.50 m. However, to extend the use to glazing units of larger size and/or glazing units exposed to extreme stressing conditions, it will be preferred to design glazing units whose insert is capable of withstanding a force of 5700 N per linear meter. To achieve such a buckling strength, we give below a table indicating the safety factor calculated with respect to the 5700 N/m reference as a function of the corresponding thicknesses to be given to the insert of the invention depending on the type of material.

| Safety Factor | Styrene acrylonitrile (SAN) | Aluminum | Stainless steel |
|---|---|---|---|
| 1 | 0.50 mm | 0.25 mm | 0.20 mm |
| 3 | 0.75 mm | 0.40 mm | 0.30 mm |
| 4.5 | 0.90 mm | 0.45 mm | 0.35 mm |

Figure 1B:
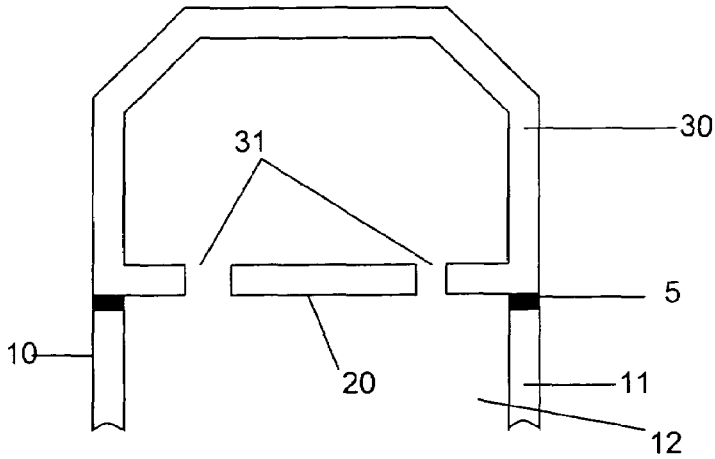
FIG. 1*b* is a partial schematic sectional representation of an insulating glazing unit according to the invention, in which the hollow strip is adhesively bonded directly to the edges of the glass sheets.
Figure 1C:
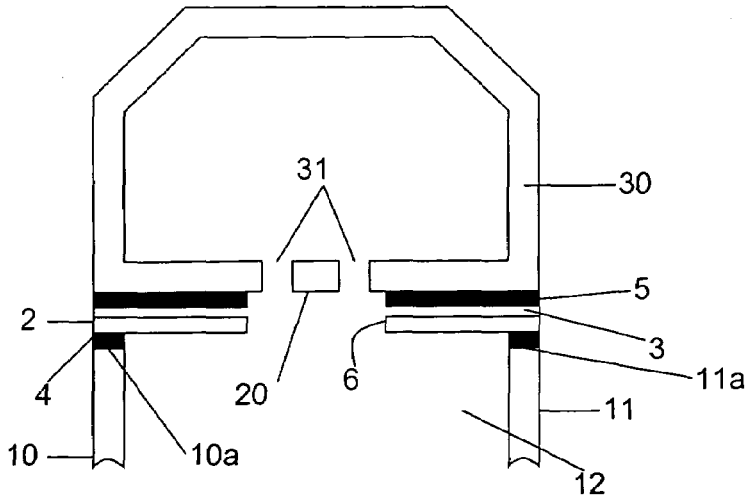
FIG. 1*c* is a partial schematic sectional representation of an insulating glazing unit according to the invention, in which the hollow strip is adhesively bonded to the edges of the glass sheets via the interposition of a substantially flat strip.
Figure 1D:
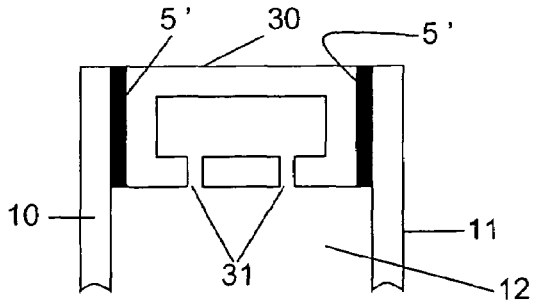
FIG. 1*d* is a partial schematic sectional representation of an insulating glazing unit according to the invention, in which the hollow strip is adhesively bonded between the glass sheets.

The integration of the hollow strip into the insulating glazing unit of the invention is illustrated in FIGS. 1*b* to 1*d*.

Referring to FIG. 1*b*, the hollow strip 30 is adhesively bonded by fastening means 5 to the edges of the glass sheets 10 and 11 Thus, the internal face 20 of the insert is a boundary of the gas-filled cavity 12, so that the desiccating molecular sieve (not shown) contained in the hollow profile is active with respect to the gas-filled cavity via communications 31—holes, pores, etc.—made in the internal face 20 if necessary, these communications 31 with the gas-filled cavity are exposed by locally removing a possible sealing layer with which the strip 30 would be provided. The dimensions of the communications 31 are smaller than those of the desiccant, which frequently is in the form of granules, so as to retain them in the hollow strip 30.

The fastening means 5 guarantee the required sealing between the gas-filled cavity 12 and the outside atmosphere.

The hollow strip is placed over all or part of a straight side of the insulating glazing unit, in a single section or in several sections having a length, for example, of 10 to 15 cm. Optionally, the hollow strip may be blocked off with a hot-melt material having a low moisture transmission, such as a polyurethane.

A substantially flat section (not shown in FIG. 1*b*) is adhesively bonded to each of the two end sections of the hollow strip 30, that it thus blocks off in a sealed manner, possibly in combination with the aforementioned hot-melt material having a low moisture transmission.

The flat strip 2 (see FIG. 1*a*) includes sealing means, consisting as described above of an aluminum foil 3, which may be oriented toward the inside of the glazing unit, the adhesive 4 being chosen to bond the aluminum to the hollow profile 30 and also to the edges of the glass sheets. This orientation of the sealing means 3 has the advantage of allowing the external face of the flat strip 2, for example made of plastic, to be formed with striations, for fastening the glazing unit as described in application EP-745 750 A1, especially by extrusion.

The situation of the hollow strip 30, at least partly to the outside of the space bounded by the glass sheets, allows it to be used in mounting the glazing unit by insertion into a groove formed in the frame of the opening, without an additional step of fastening a cover strip being necessary. Such is also the advantage afforded by the embodiment shown in FIG. 1*c*, to which reference will now be made.

According to this embodiment, a substantially flat strip 2 provided with its outwardly oriented sealing means 3 surrounds the entire perimeter of the insulating glazing unit, being bonded by the adhesive 4 to the edges of the glass sheets. The flat strip 2 has a hole 6 which, for example, may be cut after the flat strip has been bonded to the glass sheets and possibly after a certain period of use of the glazing unit resulting therefrom. A hollow strip 30 has therefore in this case been subsequently bonded to the flat strip 2 by the adhesive 5 The molecular sieve contained in the hollow of the strip 30 is active with respect to the gas-filled cavity 12, with which it communicates via the pores or holes 31 made in the internal wall 20 of the strip 30 and via the hole 6.

The hollow strip 30 may in this case also be blocked off at its ends with a thermoplastic having a low moisture transmission. Supplementary sealing means (not shown) are opportunely used between the flat strip 2 and the hollow strip 30, namely adhesive tape or injection of suitable materials in order to seal off the lateral open overlap sections (see above). These supplementary means are removable, so that regeneration of the molecular sieve of the strip 30, possible after a long period of use of several years, is particularly simplified by the arrangements of the invention.

FIG. 1*d* shows a variant in which a hollow strip 30 is fitted entirely within the space bounded by two glass sheets 10 and 11 of an insulating glazing unit by adhesive bonding using a material 5' capable of providing the required sealing between the gas-filled cavity and the outside atmosphere, but only over part of the periphery of the glazing unit, preferably over part or all of a straight side of the glazing unit. A substantially flat strip (not shown) overlaps and is adhesively bonded to at least each of the two end sections of the hollow strip 30 so as to provide, or at least contribute to, the required sealing between the recess of the hollow strip 30 and the outside atmosphere. Thus, all that is required is to debond a sufficient part of the flat strip 2 in order to expose one end of the hollow strip 30 so as to replace the spent desiccant that it contains and then to rebond it.

The manufacturing process will now be described with reference to the preferred embodiment of the invention, using a substantially flat strip based on a reinforced thermoplastic. This description excludes the integration into the insulating glazing unit of the hollow strip, said integration being described above; this integration is carried out before the flat strip is assembled (the embodiments shown in FIGS. 1*b* and 1*d*) or thereafter (the embodiment shown in FIG. 1*c*).

The glass sheets 10 and 11 are conveyed on edge by standard means and taken into a chamber that may contain the gas to be introduced into the glazing unit.

The glass sheets 10 and 11 are held, with the desired spacing, by means of suckers placed on the external faces of the glazing unit and controlled by pneumatic cylinders.

Figure 2:
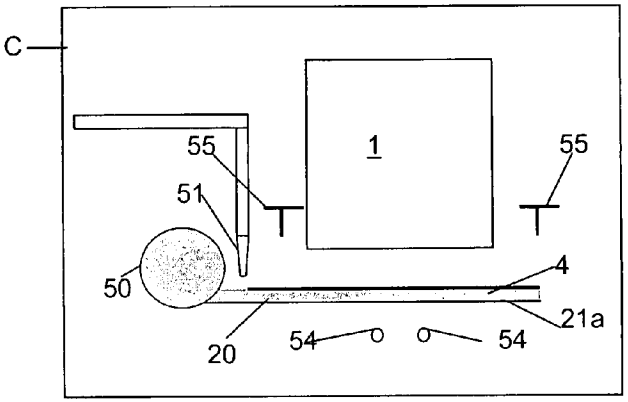
FIG. 2 illustrates a schematic vertical view of the device for applying the substantially flat strip to the glass sheets.

FIG. 2 illustrates schematically the device for manufacturing the glazing unit enclosed in the chamber 2.

A reel 50 constitutes the magazine of the strip 2 which is unwound and stretched, using a stretching device (not shown), in the form of a tape which is cut to a length equivalent to the perimeter of the glazing unit, the width of the tape corresponding to the total thickness of the glazing unit.

Once the strip has been made out flat, the adhesive 4 is deposited using injection means 51, such as a nozzle, on the internal face 20 of the tape, intended to be applied against the edge of the glazing unit. In this case, the tape includes the desiccant inherent in its internal face, the desiccant having been incorporated in the form of powder or granules into the reinforced thermoplastic during manufacture of the strip.

However, when the desiccant is to be added after the strip has been manufactured, it will be preferred to put the desiccant and the adhesive in place during one and the same operation using three injection nozzles, namely two lateral nozzles, directed toward the edges of the tape in order to deposit adhesive for the purpose of being opposite the edges of the glazing unit, and one central nozzle injecting the desiccant onto the central part 22 of the tape for the purpose of being opposite the gas-filled cavity.

It is also possible to envision an adhesive which has been deposited during manufacture of the strip and which is protected until it is used, corresponding in this case to when the strip is applied to the glazing unit.

At least one press roller 54, controlled by an articulated arm (not shown) applies the tape 2 and presses it against the edge of the glazing unit 1 over its entire perimeter. To save time in the surrounding operation, it will be preferable to provide two rolls 54, which will be driven in the two opposed directions and will border the two halves of the perimeter simultaneously.

Heating means 55, such as hot-wire resistors, are provided in order to heat the strip before it is bent and applied at the corners of the glazing unit.

The operation of the device is as follows.

The two glass sheets 10, 11 held spaced apart are fixedly positioned in the center of the chamber C.

Beneath the glazing unit, the strip or tape 2, including the desiccant and the sealing means 4, is unwound, stretched and cut.

The two press rollers 54 are brought into contact with the tape in order to apply the latter at the midpoint of the lower horizontal side of the glazing unit. Once the tape has been pressed against the edge of the glazing unit, the bordering operation is started at the midpoint, thus ensuring that the tape is under tension.

The rolls 54 then move in opposite directions toward the bottom left corner 13 and bottom right corner 14 of the glazing unit.

Figure 3:
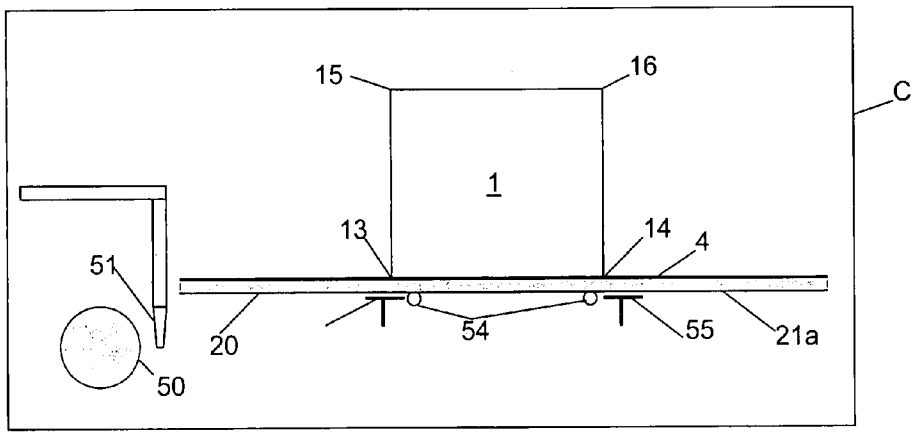
FIG. 3 shows FIG. 2 during one step of the manufacturing process.

Before the press rollers 54 start to go around the two corners 13 and 14, they are momentarily stopped while the hot wires 55 are put into place downstream of the rollers, close to and facing the metal foil 21*a* of the strip in order to heat the thermoplastic intended to be applied against the corners (FIG. 3).

After the strip has been softened, the press rollers 54 are again put into operation in order to bend the strip and border the corners 13 and 14 of the glazing unit correctly. The rollers then continue to travel around the perimeter of the glazing unit up to the top corners 15 and 16 of the glazing unit, when the operation of heating the strip is repeated by means of hot wires 55.

Figure 4:
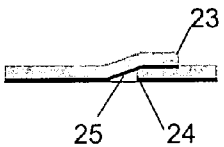
FIG. 4 is an enlarged view of the join between the two free ends of the flat strip according to the invention after completely surrounding the glazing unit.

Once the top corners of the glazing unit have been surrounded, the press rollers 54 finish by bordering the last side of the glazing unit. On approaching the middle of this last side, one of the rollers is stopped while the other roller continues to compress the strip until the free end 23 of the strip associated with this operating roller overlaps the other end 24 of the strip put into place (FIG. 4). The surrounding operation is then complete and the press rollers 54 are disengaged from the glazing unit.

To strengthen the fastening of the two ends 23 and 24 of the tape and above all to seal the two open lateral sections 25 of the tape which are due to the overlapping of the ends, supplementary sealing means, such as adhesive, are injected so as to close off these said sections 25.

An alternative method (not illustrated) of joining the two ends of the tape together may consist not in overlapping them but in abutting them, one against the other, when they have complementary shapes designed to mutually cooperate in the manner of a tenon and a mortice. To ensure complete sealing, adhesive or adhesive tape, impermeable to gases and to water vapor, such as a stainless steel adhesive tape, will be added to the abutment region.

Although the two ends of the tape have been joined together whether by overlap or by abutment, on one of the sides of the glazing unit, it is also possible as a variant to make this joint at a corner of the glazing unit.

Moreover, in alternative method of implementing the process, provision may be made for there to be two heads 56*a*, 56*b* for delivering the tape 2, respectively a stationary head and a head that can move vertically, each head associated with a press roller 54, the glazing unit being able to be moved in horizontal translation.

Figures 5A, 5B, 5C:
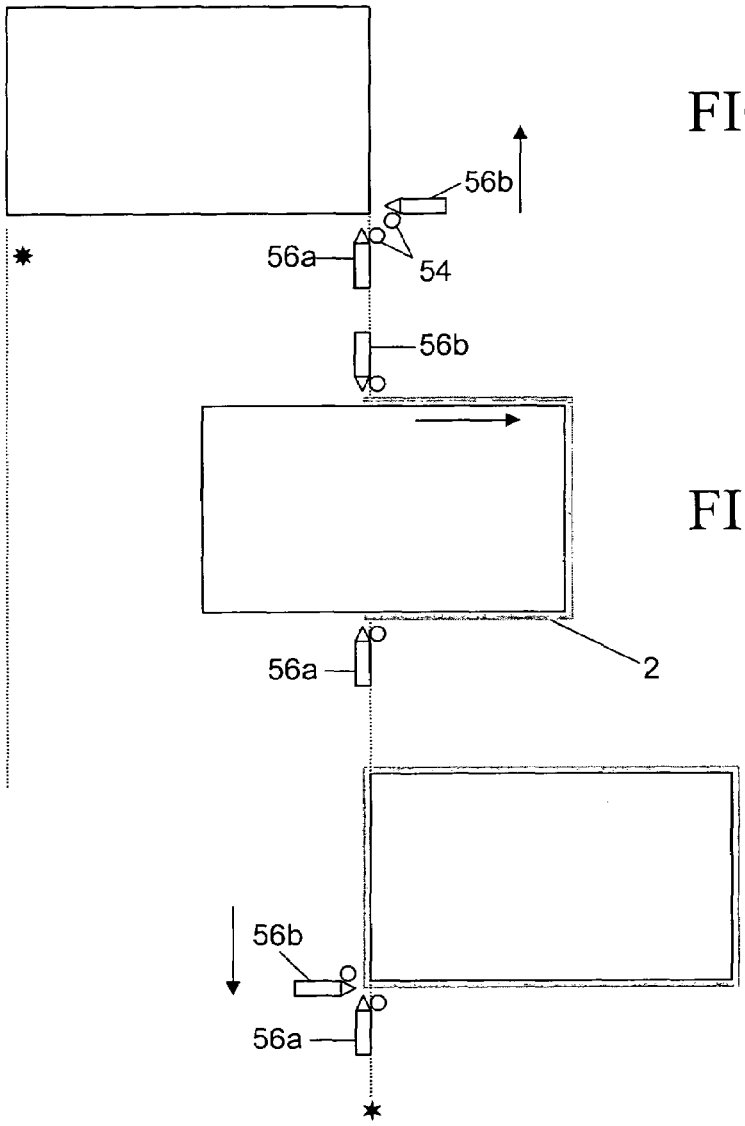
FIGS. 5*a* to 5*c* illustrate an alternative method of surrounding the glazing unit, in a configuration in which the hollow strip is entirely located within the space bounded by the glass sheets.

Referring to FIG. 5*a*, the glazing unit, having entered the chamber C (not illustrated here) is placed between position ① corresponding to the front of the glazing unit and position ② corresponding to the rear of the glazing unit. At the start, the movable head 56*b* begins from a bottom corner of the glazing unit corresponding to position ① and is driven upward so as to follow the front vertical side of the glazing unit. Once the head 56*b* has reached the top corner, it pivots through 90° and is stopped, the two heads then facing one another. The glazing unit is then moved translationally from the left to the right, that is to say the rear of the glazing unit goes from position ② to position ① so that the horizontal sides of the glazing unit are simultaneously surrounded by each of the heads respectively (FIG. 5*b*). Finally, the rear of the glazing unit is stopped in position ① and the vertical side is surrounded by the movable head that has pivoted through 90° at the upper corner of the glazing unit in order to descend down to the bottom corner (FIG. 5*c*). The two tapes are then fastened together in the bottom corners of the glazing unit by overlap or by abutment.

This combination of the translational movement of the glazing unit and that of at least one tape delivery head makes it possible to save time in surrounding the glazing unit.

Furthermore, this combination of movements and the use of the strip of the injection makes it possible to surround glazing units of complex shapes, having for example curved edges with concave and/or convex shapes.

An alternative method of filling with the gas that has to be contained in the glazing unit may be envisioned. Instead of having to have a gas-filled chamber, a gas feed device is provided, such as a hose which is inserted between the two glass sheets and delivers gas as the edges of the glazing unit are being surrounded and sealed off. The device is removed just before the last side of the glazing unit is closed off.

The strip of the invention has a flat and parallelepipedal overall shape, however, alternative embodiments are possible. For example, it may be envisioned to provide the internal face 20 of the strip, on the opposite side to that having the metal coating, with centering and positioning means such as longitudinal projections or lugs uniformly distributed along two longitudinal lines separated by a width equivalent to the separation of the two glass sheets so that the strip is suitably guided and positioned against the edge of the glazing unit, the projections or lugs being inserted into the glazing unit and being pressed against the internal walls.

The invention claimed is:

1. An insulating glazing unit, comprising:

two glass sheets spaced apart by a gas-filled cavity;

an insert that serves to keep the two glass sheets apart and that has an internal face facing the gas-filled cavity and an opposed external face; and means for sealing with respect to an inside of the glazing unit, wherein the insulating glazing unit does not include a spacer contacting facing surfaces of the glass sheets, and the insert comprises a substantially flat first strip that surrounds a first part of a perimeter of the glazing unit, being pressed by its internal face against edges of the glass sheets and kept fastened by fastening means, and a second strip that surrounds a second part of the perimeter of the glazing unit wherein said second strip is pressed by its internal face against the edges of the glass sheets without interposition of the flat first strip, except at end portions of the flat first strip and the second strip to provide a seal.

2. The glazing unit as claimed in claim 1, wherein said second strip comprises at least a part that lies outside a space bounded by the glass sheets and that has a shape configured to at least one of fit and fasten the glazing unit in an opening for which the glazing unit is intended.

3. The insulating glazing unit as claimed in claim 1, wherein the insert possesses properties configured to seal against gases and dust and against liquid water.

4. The insulating glazing unit as claimed in claim 1, wherein the means for sealing are placed at least on the external face of the substantially flat first strip.

5. The insulating glazing unit according to claim 1, wherein the means for sealing are placed at least on the internal face of the insert.

6. The insulating glazing unit as claimed in claim 5, wherein the external face of said substantially flat first strip has irregularities configured to at least one of set, center, and fasten the glazing unit in an opening for which the glazing unit is intended.

7. The glazing unit as claimed in claim 6, wherein said irregularities include longitudinal striations obtained by extrusions of a thermoplastic.

8. The glazing unit as claimed in claim 1, wherein at least one of the faces of the insert has longitudinal elements structured by forming or securely attached.

9. The glazing unit as claimed in claim 1, wherein part of the insert includes a painting or lacquering anticorrosion treatment or a printing-based marking treatment.

10. The insulating glazing unit as claimed in claim 1, wherein the means for sealing includes a metal coating.

11. The insulating glazing unit as claimed in claim 1, wherein said substantially flat first strip is made entirely of metal, or of stainless steel with a thickness of at least 0.10 mm, or of aluminum with a thickness of at least 0.15 mm, or is made of a thermoplastic that includes continuous or chopped reinforcing glass fibers to have a thickness of at least 0.2 mm.

12. The insulating glazing unit according to claim 1, wherein said substantially flat first strip has a linear buckling strength of at least 400 N/m.

13. The insulating glazing unit as claimed in claim 1, wherein the fastening means are impermeable to water vapor and to gases.

14. The insulating glazing unit as claimed in claim 1, wherein the fastening means includes an adhesive.

15. The insulating glazing unit as claimed in claim 14, wherein the adhesive has a tear strength of at least 0.45 MPa.

16. The insulating glazing unit as claimed in claim 1, wherein said substantially flat first strip has two free ends joined together to surround part of the glazing unit so that one of the ends overlaps one end of said second strip, and further comprising supplementary sealing means for sealing off lateral sections left open by the overlap.

17. The insulating glazing unit as claimed in claim 1, further comprising an adhesive tape or adhesive, impermeable to gases and to water vapor, applied to a region of the abutment.

18. The insulating glazing unit as claimed in claim 1, wherein the glazing unit has a complex shape, with curved parts.

19. The insulating glazing unit as claimed in claim 1, wherein the insert includes at least one of a desiccant, electrical-connection, mechanical-transmission means, a venetian blind installed in the gas-filled cavity, means for measuring moisture content and a mechanism configured to fasten cross members installed in the gas-filled cavity.

20. The insulating glazing unit as claimed in claim 1, wherein the insert includes at least one hole.

21. The insulating glazing unit as claimed in claim 1, wherein the edges of the two glass sheets are at least partly offset with respect to each other.

22. An insulating glazing unit, comprising:

two glass sheets spaced apart by a gas-filled cavity;

an insert that serves to keep the two glass sheets apart and that has an internal face facing the gas-filled cavity and an opposed external face; and means for sealing with respect to an inside of the glazing unit, wherein the insert comprises a substantially flat first strip that surrounds a first part of a perimeter of the glazing unit, being pressed by its internal face against edges of the glass sheets and kept fastened by fastening means, and a second strip that surrounds a second part of the perimeter of the glazing unit, wherein at least one of said two glass sheets includes a through-hole and edges of this through-hole form part of said first part of the perimeter of the glazing unit, a substantially flat third strip being pressed against and adhesively bonded in a leaktight manner to the edges of the through-hole.

23. A process for manufacturing an insulating glazing unit as claimed in claim 1, wherein:

said second strip is provided with the fastening means for fastening to the glazing unit and is joined to the two glass sheets, which are kept parallel and spaced apart, to be assembled, the process comprising:

placing the internal face of the substantially flat first strip provided with the fastening means against the edges of the glass sheets and, on an external face of the second strip;

during placing the substantially flat first strip, applying pressure means almost instantaneously on the external face of the substantially flat first strip to ensure that it adheres to the edges of the glass sheets and to the second strip; and securely joining each end of the substantially flat first strip to one end of the second strip.

24. The process for manufacturing an insulating glazing unit as claimed in claim 23, wherein before the placing step the substantially flat first strip is in a form of a wound tape and the process further comprises unwinding, stretching and cutting the tape to a desired length and depositing the fastening means by injection onto the tape being stretched.

25. The process for manufacturing an insulating glazing unit as claimed in claim 24, further comprising:

depositing a desiccant onto the tape being stretched, during the depositing of the fastening means.

26. The process for manufacturing an insulating glazing unit as claimed in claim 23, further comprising:

inserting a gas feed device between the two glass sheets, to deliver gas, while the glazing unit is undergoing the surrounding operation, and removing said gas feed device just before an end of the surrounding operation.

27. The process for manufacturing an insulating glazing unit as claimed claim 1, further comprising:

spacing the two glass sheets apart and in parallel;

placing the internal face of the substantially flat first strip, provided with the means for fastening it against the edges of the glass sheets, around a first part of a perimeter of the glazing unit;

applying pressure almost instantaneously on an external face of the substantially flat strip to ensure that it adheres to the edges of the glass sheets;

securing after the entire glazing unit has been surrounded, the two ends of the substantially flat strip together; and sealing a hole in the substantially flat strip by said second strip, the hole being drilled by coming-together of the substantially flat strip and the second strip shaped for this purpose.

* * * * *